US010741118B2

(12) United States Patent
Park et al.

(10) Patent No.: US 10,741,118 B2
(45) Date of Patent: Aug. 11, 2020

(54) LIGHT-EMITTING DIODE DISPLAY DEVICE AND METHOD OF OPERATING THE SAME

(71) Applicant: Samsung Electronics Co., Ltd., Suwon-si, Gyeonggi-do (KR)

(72) Inventors: Ji-yong Park, Suwon-si (KR); Sang-kyun Im, Seoul (KR); Young-hoon Cho, Yongin-si (KR); Hye-rin Choi, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 68 days.

(21) Appl. No.: 15/803,000

(22) Filed: Nov. 3, 2017

(65) Prior Publication Data

US 2018/0130404 A1 May 10, 2018

(30) Foreign Application Priority Data

Nov. 4, 2016 (KR) ..... 10-2016-0146912

(51) Int. Cl.

| | |
|---|---|
| ***G09G 3/32*** | (2016.01) |
| ***H05B 45/00*** | (2020.01) |
| ***H05B 45/50*** | (2020.01) |
| ***G09G 3/34*** | (2006.01) |

(52) U.S. Cl.

CPC ..... *G09G 3/32* (2013.01); *G09G 3/3413* (2013.01); *H05B 45/00* (2020.01); *H05B 45/50* (2020.01); *G09G 2310/0202* (2013.01); *G09G 2310/0216* (2013.01); *G09G 2320/0247* (2013.01);

(Continued)

(58) Field of Classification Search

CPC ..... G09G 3/342; G09G 2360/141; G09G 2320/064

See application file for complete search history.

(56) References Cited

U.S. PATENT DOCUMENTS 8,031,153 B2 10/2011 Kang et al.
2005/0243024 A1* 11/2005 Sempel ..... G09G 3/20 345/55

(Continued)

FOREIGN PATENT DOCUMENTS

EP 1580721 9/2005
JP 2004-13115 1/2004

(Continued)

OTHER PUBLICATIONS

Extended European Search Report dated Jan. 29, 2018 in European Patent Application No. 17199465.0.

*Primary Examiner* — Yuzhen Shen
(74) *Attorney, Agent, or Firm* — Staas & Halsey LLP

(57) ABSTRACT

Provided are a light-emitting diode (LED) display device and a method of operating the LED display device determining whether a line flicker will occur based on a level of an input image signal, obtaining an LED line scan order corresponding to the level of the input image signal and brightness according to the input image signal based on the determining, and driving at least one LED line based on the LED line scan order. An LED line scan order may be adjusted according to a level of an input/output image signal in an LED display device so as to reduce occurrence of a line flicker phenomenon in all levels of the input/output image signal.

20 Claims, 5 Drawing Sheets

(52) U.S. Cl.
CPC ..... *G09G 2320/0261* (2013.01); *G09G 2320/0626* (2013.01); *G09G 2360/16* (2013.01)

(56) References Cited

U.S. PATENT DOCUMENTS

| | | | | |
|---|---|---|---|---|
| 2013/0293742 | A1* | 11/2013 | Moon | H04N 5/2357 348/226.1 |
| 2015/0146998 | A1* | 5/2015 | Fuchigami | H04N 5/2357 382/275 |
| 2016/0078798 | A1* | 3/2016 | Watanabe | G09G 3/2007 345/690 |
| 2016/0086557 | A1* | 3/2016 | Watanabe | G09G 3/3648 345/691 |

FOREIGN PATENT DOCUMENTS

| | | |
|---|---|---|
| KR | 10-2003-0090408 | 11/2003 |
| KR | 10-1386365 | 6/2008 |
| WO | 03/105114 | 12/2003 |

* cited by examiner

600

| LEVEL OF IMAGE INPUT SIGNAL (8bits) | TYPE OF LED LINE SCAN ORDER |
|---|---|
| 0 | TYPE 0 |
| 1 | TYPE 1 |
| ~ | ~ |
| 255 | TYPE 255 |

LIGHT-EMITTING DIODE DISPLAY DEVICE AND METHOD OF OPERATING THE SAME

CROSS-REFERENCE TO RELATED APPLICATION

This application claims the benefit of Korean Patent Application No. 10-2016-0146912, filed on Nov. 4, 2016, in the Korean Intellectual Property Office, the disclosure of which is incorporated herein in its entirety by reference.

BACKGROUND

1. Field

The present disclosure relates to a light-emitting diode (LED) display device in which occurrence of a flicker phenomenon is reduced, a method of operating the LED display device, and a non-transitory computer-readable recording medium having recorded thereon a program which, when executed by a computer, performs the method.

2. Description of the Related Art

Generally, a light-emitting diode (LED) display device is a representative passive matrix device, has a pixel structure in which LEDs are arranged at regular intervals, and displays an image by representing various colors via red, green, and blue (RGB) combinations. Based on intervals of LEDs, an LED display device having a large LED pitch size is used as an outdoor electronic board for transmitting information, and an LED display device having a minute LED pitch size is used as a display device for more general purposes, such as for a television (TV).

The LED display device is advantageous in terms of brightness and a contrast ratio according to high light efficiency of the LEDs, but a line flicker phenomenon may occur since the LED display device does not use a holding method like an active matrix device. The line flicker phenomenon denotes a phenomenon in which a screen displayed by the LED display device has a white line or flickers.

SUMMARY

Provided are a light-emitting diode (LED) display device in which a line scan order of an LED module is adjusted so as to reduce occurrence of a line flicker phenomenon, a method of operating the LED display device, and a non-transitory computer-readable recording medium having recorded thereon a program which, when executed by a computer, performs the method.

Additional aspects will be set forth in part in the description which follows and, in part, will be apparent from the description, or may be learned by practice of the presented embodiments.

According to an aspect of an embodiment, a light-emitting diode (LED) display device includes: an LED module including at least one LED line; an LED driver configured to drive the LED module; and a controller configured to determine whether a line flicker will occur based on a level of an input image signal, obtain an LED line scan order corresponding to the level of the input image signal and a brightness of an image displayable on the LED display device according to the input image signal, based on the determining, and control the LED driver to drive the LED module based on the LED line scan order obtained.

The LED line scan order obtained when determining that the line flicker will occur may be different from the LED line scan order obtained when determining that the line flicker will not occur.

The controller may determine that the line flicker will occur when the level of the input image signal is less than or equal to a pre-set value.

The pre-set value may be determined based on an external input.

The LED display device may further include a memory, wherein the controller may obtain, from the memory, data to control the at least one LED line according to the LED line scan order, and transmit the obtained data to the LED driver.

The LED display device may further include a table including information about LED line scan orders corresponding to levels of input image signals and brightnesses.

In the information about LED line scan orders corresponding to levels and brightnesses, an LED line scan order obtained when determining that line flicker will occur may be different from an LED line scan order obtained when determining that line flicker will not occur.

The controller may control the LED driver based on the determining of whether the line flicker will occur whenever a frame of the input image signal is changed.

The controller may control the LED driver based on the determining of whether the line flicker will occur during a period where the LED module does not operate between adjacent frames of the input image signal.

The LED display device may further include a plurality of the LED modules, and the controller may control the LED driver based on the determining of whether the line flicker will occur in at least one LED module.

According to an aspect of another embodiment, a method of operating a light-emitting diode (LED) display device including an LED module including at least one LED line, the method includes: determining whether a line flicker will occur, based on a level of an input image signal; obtaining an LED line scan order corresponding to the level of the input image signal and a brightness of an image displayable on the LED display device according to the input image signal, based on the determining; and driving the at least one LED line based on the LED line scan order obtained.

According to an aspect of another embodiment, a non-transitory computer-readable recorded medium has recorded thereon a program which, when executed by a computer, performs the method.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
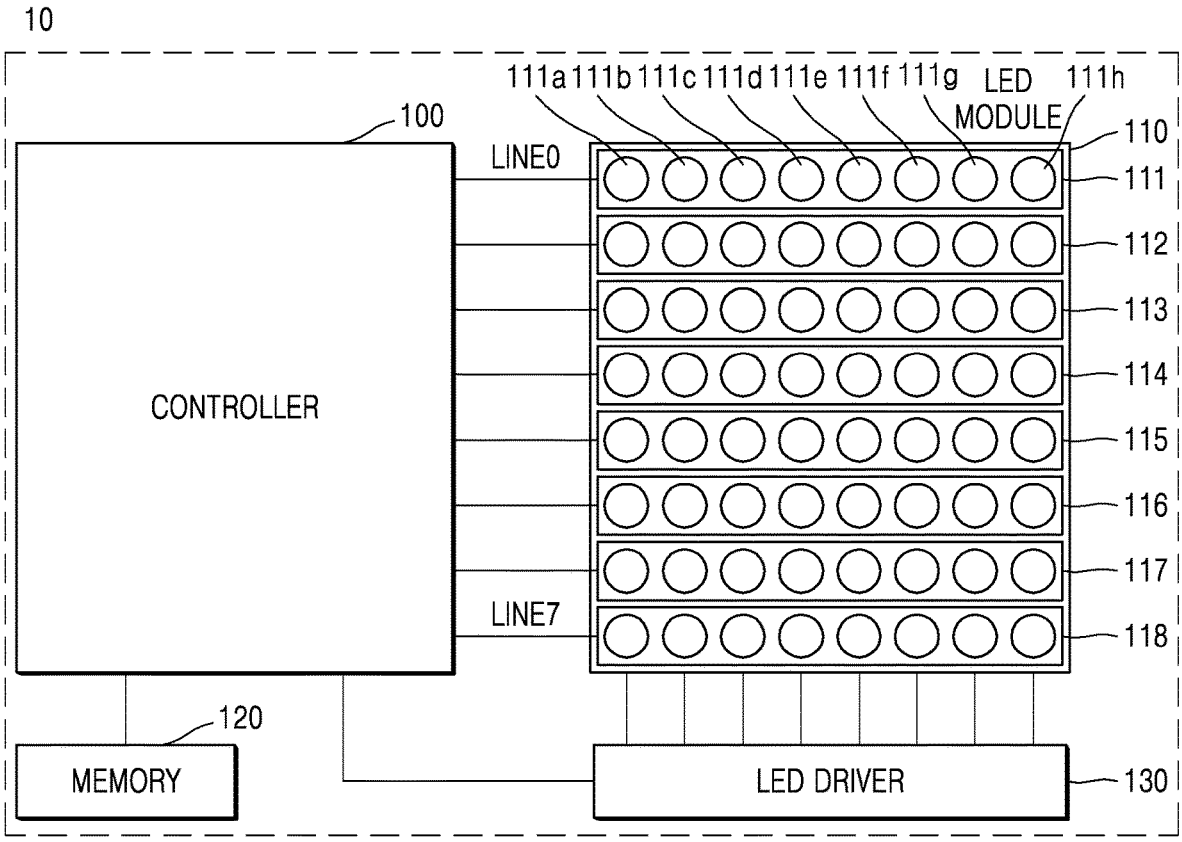
FIG. 1 is a block diagram of a structure of a light-emitting diode (LED) display device, according to an embodiment.

Hereinafter, the terms used in the specification will be briefly defined, and the embodiments will be described in detail.

All terms including descriptive or technical terms which are used herein should be construed as having meanings that are obvious to one of ordinary skill in the art. However, the terms may have different meanings according to the intention of one of ordinary skill in the art, precedent cases, or the appearance of new technologies. Also, some terms may be arbitrarily selected by the applicant, and in this case, the meaning of the selected terms will be described in detail in the detailed description of the present disclosure. Thus, the terms used herein have to be defined based on the meaning of the terms together with the description throughout the specification.

When a part "includes" or "comprises" an element, unless there is a particular description contrary thereto, the part can further include other elements, not excluding the other elements. In the following description, terms such as "unit" and "module" indicate a unit for processing at least one function or operation, wherein the unit and the block may be embodied as hardware or software or embodied by combining hardware and software.

One or more embodiments of the present disclosure will now be described more fully with reference to the accompanying drawings. However, the one or more embodiments of the present disclosure may be embodied in many different forms, and should not be construed as being limited to the embodiments set forth herein; rather, these embodiments are provided so that this disclosure will be thorough and complete, and will fully convey the concept of the one or more embodiments of the present disclosure to those of ordinary skill in the art. In the following description, well-known functions or constructions are not described in detail since they would obscure the one or more embodiments of the present disclosure with unnecessary detail, and like reference numerals in the drawings denote like or similar elements throughout the specification.

FIG. 1 is a block diagram of a structure of a light-emitting diode (LED) display device 10, according to an embodiment.

Referring to FIG. 1, the LED display device 10 according to an embodiment may include a controller 100, an LED module 110, a memory 120, and an LED driver 130.

The controller 100 includes one or more processors to perform operations for driving and controlling the LED display device 10. For example, the controller 100 may control the LED driver 130, and select an LED line to be driven by the LED module 110 by transmitting a signal to the LED module 110. Also, the controller 100 may control the memory 120 to store data.

The controller 100 may receive an input image signal from an external source, and control the LED module 110 and the LED driver 130 based on the received input image signal. Also, the controller 100 may control the LED module 110 and the LED driver 130 in units of a frame. Frames may be distinguished by a frame-distinguishing signal from among the input image signal. The frame-distinguishing signal may be a vertical synchronization signal but is not limited thereto.

The LED module 110 is an electronic component in which one or more LEDs are mounted on a substrate. The LED module 110 may include at least one LED line. The LED line denotes a group of at least one LED in a row or a column. Each LED may repeat quick flickering tens to hundreds of times per second such that a screen is displayed.

The LED module 110 may be driven in units of LED lines by a signal from the controller 100. For example, when the LED module 110 includes eight LED lines 111 through 118, i.e., Line0 to Line7, as shown in FIG. 1, and the controller 100 transmits a signal to Line0, the LED line 111 corresponding to the Line0 may be driven in the LED module 110.

Generally, the LED lines 111 through 118 of the LED module 110 are sequentially scanned. For example, Line1 may be turned on and then off after Line0 is turned on and then off, and Line2 through Line7 may be consecutively turned on and then off. Accordingly, when a user looks at a screen displayed by the LED display device 10 while moving his or her eyes from top to bottom or from bottom to top, the user may see a white line on the screen. This is referred to as a line flicker phenomenon.

Meanwhile, in order to control each LED included in each of the LED lines 111 through 118, the LED module 110 may receive a signal from the LED driver 130. For example, when the LED line 111 corresponding to Line0 includes eight LEDs 111*a* through 111*h*, the LED driver 130 may transmit a signal controlling each of the eight LEDs 111*a* through 111*h* to the LED module 110.

The signal transmitted from the LED driver 130 to the LED module 110 may be a signal corresponding to data for controlling each of the LED lines 111 through 118, and the data for controlling the LED lines 111 through 118 may be obtained from the memory 120. Also, the signal transmitted from the LED driver 130 to the LED module 110 may be synchronized with a control signal transmitted from the controller 100 to the LED driver 130.

Also, the LED module 110 may receive a signal from the controller 100 to select an LED line to be driven from among the LED lines 111 through 118, and may receive a signal from the LED driver 130 to determine which LED is to be turned on and off from among LEDs included in the selected LED line. Each LED may generate a pixel at a point where two electrodes that orthogonally cross each other meet.

The memory 120 is hardware storing various types of data processed in the LED display device 10, and may store various types of data, programs, or applications for driving and controlling the LED display device 10 via control of the controller 100. The memory 120 may store input/output signals or data corresponding to driving of the LED module 110 and the LED driver 130. For example, the memory 120 may store data for controlling each of the at least one LED line included in the LED module 110.

The memory 120 may include a random access memory (RAM), such as a dynamic random access memory (DRAM) or a static random access memory (SRAM), a read-only memory (ROM), an electrically erasable programmable read-only memory (EEPROM), a CD-ROM, a Blu-ray or another optical disk storage, a hard disk drive (HDD), a solid state drive (SSD), or a flash memory, and in addition, may include an external storage device accessible to the LED display device 10.

The LED driver 130 may be a semiconductor or an integrated circuit providing a driving signal and data as electric signals so as to drive each LED included in the LED module 110. For example, the LED driver 130 may receive a control signal from the controller 100 to determine a point of time when each of the LED lines 111 through 118 included in the LED module 110 is to be turned on, and control which LEDs from among the LEDs included in each of the LED lines 111 through 118 are to be turned on at the determined point of time. The LED driver 130 may receive data for controlling, by the controller 100, each of the LED lines 111 through 118 from the memory 120.

Figure 2:
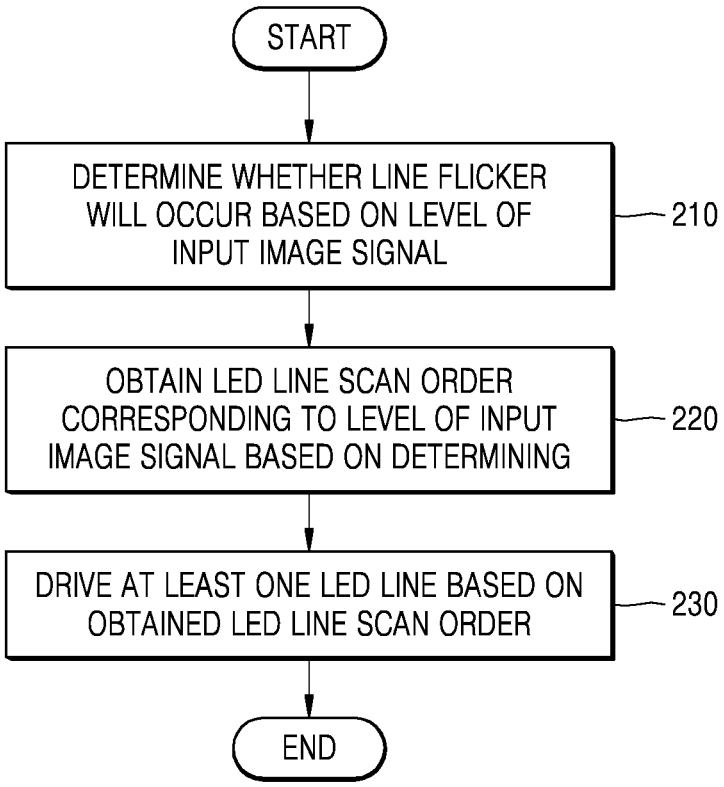
FIG. 2 is a flowchart of a method of adjusting, by an LED display device, an LED line scan order, according to an embodiment.

FIG. 2 is a flowchart of a method of adjusting, by an LED display device, an LED line scan order, according to an embodiment.

Referring to FIG. 2, in operation 210, the LED display device may determine whether line flicker will occur based on a level of an input image signal. The level of the input image signal is a type of data input to the LED display device through the input image signal. The level of the input image signal may be a gray level or a color level.

According to an embodiment, the LED display device may determine whether the line flicker will occur based on the gray level of the input image signal. The gray level is data indicating a degree of black and white contrast and is used while forming an image by assigning black and white contrast to each point on a screen instead of a color. For example, an 8-bit gray level may indicate total 256 degrees of black and white contrast, from 0 to 255. The level of input image signal will be described in detail below with reference to FIG. 3.

The determining of whether the line flicker will occur by the LED display device means predicting whether the line flicker will occur or not in advance. The LED display device may pre-determine whether the line flicker will occur before displaying an image corresponding to a frame of the input image signal on a screen.

According to an embodiment, the LED display device may determine that the line flicker will occur when the level of the input image signal is less than or equal to a pre-set value. Since a line flicker phenomenon is highly lightly to occur when a dark image is displayed on the screen, the LED display device may determine that the line flicker will occur when the level of the input image signal is less than or equal to the pre-set value.

For example, when the level of the input image signal is an 8-bit gray level, the level of the input image signal may have a value from 0 to 255, and the LED display device may determine that the line flicker will occur when the level of the input image signal is less than 30. The value 30 is only an example, and does not limit the pre-set value. A value determined to cause the line flicker may vary depending on how the level of the input image signal is defined.

According to an embodiment, the pre-set value being a criterion for determining whether the line flicker will occur may be determined based on an external input. Alternatively, the pre-set value may be self-determined by the LED display device or may be a fixed value.

In operation 220, the LED display device may obtain an LED line scan order corresponding to the level of the input image signal based on the determining. According to an embodiment, when it is determined that the line flicker will not occur, the LED display device maintains a current LED line scan order, and when it is determined that the line flicker will occur, a new LED line scan order may be obtained. Since brightness of an image displayed on the screen of the LED display device is determined by the input image signal according to the level of the input image signal, the LED display device may obtain the LED line scan order corresponding to the level of the input image signal and the brightness based on the determining.

For example, let's assume that there are six LED lines from Line0 to Line5 and the LED display device is currently sequentially scanning from Line0 to Line5. When it is determined that the line flicker will occur, the LED display device may obtain a new LED line scan order of Line0, Line2, Line4, Line1, Line3, and Line5. Such an LED line scan order is only an example, and the new LED line scan order may be an arbitrary order that does not cause line flicker.

The LED line scan order obtained when it is determined that the line flicker will occur may be adjusted differently from the LED line scan order obtained when it is determined that the line flicker will not occur because a change in the result of the determining means that the level of the input image signal is changed, and the LED line scan order corresponds to the level of the input image signal.

According to an embodiment, the LED display device may store a table including information about LED line scan orders corresponding to levels of input image signals. Alternatively, the LED display device may store a table including information about LED line scan orders corresponding to levels of input image signals and brightnesses. According to an embodiment, the table may include information about LED line scan orders corresponding to all levels of input image signals. For example, when the level is an 8-bit gray level, the table may include information about LED line scan orders respectively corresponding to levels from 0 to 255.

As another example, levels of input image signals may be divided into certain ranges, and the table may include information about LED line scan orders corresponding to the ranges. For example, when the level is an 8-bit gray level, the table may include an LED line scan order corresponding to levels from 0 to 29 and an LED line scan order corresponding to levels from 30 to 255. The table may include the information about LED line scan orders corresponding to levels of the input image signals in any one of various manners, and such manners are not limited to above examples.

According to an embodiment, in the information about LED line scan orders corresponding to levels of input image signals, which is included in the table, an LED line scan order corresponding to a level determined to cause line flicker may be adjusted differently from an LED line scan order corresponding to a level determined to not to cause line flicker.

The LED display device may obtain the LED line scan order corresponding to the level of the input image signal by using the stored table. Alternatively, the LED display device may obtain the LED line scan order corresponding to the level of the input image signal and the brightness by using the stored table. The table may be stored in a memory or in a controller of the LED display device. Also, the information about LED line scan orders corresponding to levels of the input image signals may be stored in a form other than the table.

In operation 230, the LED display device may drive at least one LED line based on the obtained LED line scan order. The LED display device may prevent occurrence of a line flicker phenomenon in all levels of input image signals by driving at least one LED line according to the obtained LED line scan order corresponding to the level of the input image signal.

The LED display device may obtain data for controlling each of the at least one LED line according to the LED line scan order. The LED display device may obtain the data for controlling each of the at least one LED line so as to scan the at least one LED line according to the obtained LED line scan order.

For example, let's assume that there are six LED lines, i.e., Line0 to Line5, and an LED line scan order is Line0, Line2, Line4, Line1, Line3, and Line5. the LED display device may sequentially obtain data for controlling Line0, data for controlling Line2, data for controlling Line4, data for controlling Line1, data for controlling Line3, and data for controlling Line5.

Also, the LED display device may transmit the obtained data to an LED driver. The LED driver may drive the at least one LED line according to the LED line scan order corresponding to the received data. The LED display device may prevent occurrence of a line flicker phenomenon in all levels of input image signals by driving the at least one LED line according to the obtained LED line scan order.

The method described above may be performed whenever a frame of the input image signal is changed. The LED display device may prevent occurrence of a line flicker phenomenon in all frames by determining whether the line flicker phenomenon will occur per frame and adjusting an LED line scan order. According to an embodiment, the LED line scan order of the LED display device may not be fixed in all frames, but may be continuously adjusted per frame so as to prevent occurrence of a line flicker phenomenon.

Alternatively, the method described above may be performed during a period where at least one LED line does not operate between adjacent frames of the input image signal. A frame is distinguished by a frame-distinguishing signal, such as a vertical synchronization signal, and an LED line may not operate during a period of time when a next frame is prepared after a frame-distinguishing signal is received. The LED display device may perform the above method during the period so as to adverse effects that may be generated by changing an LED line scan order while an LED line operates.

Meanwhile, the method described above may be performed in units of one or more LED modules when the LED display device includes a plurality of LED modules. The LED display device may include the plurality of LED modules so as to display a screen having high resolution. According to an embodiment, the LED display device may perform the above method in units of individual LED modules even though the LED display device includes the plurality of LED modules. Accordingly, each LED module may be driven according to an LED line scan order adjusted such that a line flicker phenomenon does not occur.

As another example, the LED display device may perform the above method in a unit of all of the LED modules. The LED display device may drive all of the LED modules according to an LED line scan order adjusted such that a line flicker phenomenon does not occur. In this case, the LED display device may prevent occurrence of a line flicker phenomenon in units of entire resolution, i.e., considering the entire resolution of the all of the LED modules. As another example, the LED display device may perform the above method in units of an arbitrary number of LED modules.

Figure 3:
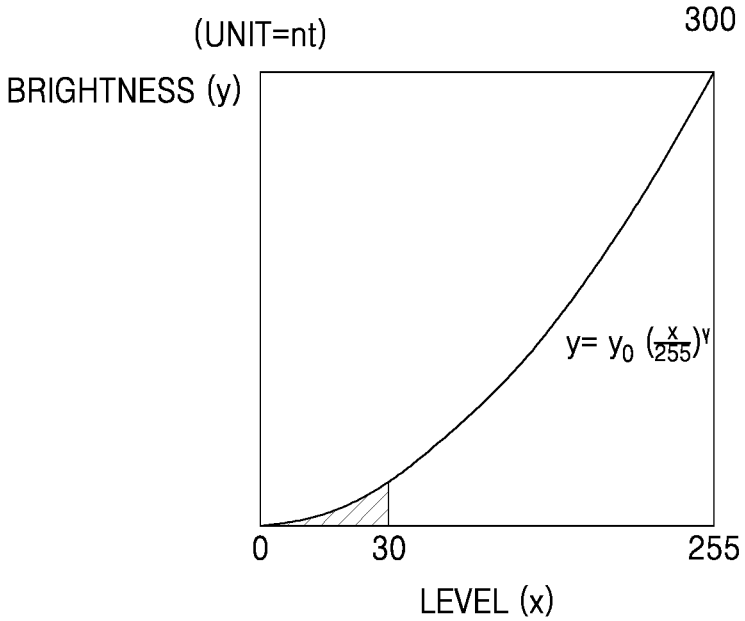
FIG. 3 is a graph illustrating a relationship between a level of an input image signal and brightness, according to an embodiment.

FIG. 3 is a graph illustrating a relationship between a level of an input image signal and brightness, according to an embodiment.

The level of the input image signal may be associated with brightness of an image displayed on a screen of an LED display device by the input image signal. For example, when the level of the input image signal is an 8-bit gray level, y denotes the brightness, and x denotes the level, the relationship may be represented as Equation 1.

$$y = y_0\left(\frac{x}{255}\right)^y \quad \text{[Equation 1]}$$

In Equation 1, $y_0$ denotes a constant, and y denotes a gamma constant of a gamma curve. The brightness and the level of the image input signal may be in a gamma function relationship.

The brightness of the image displayed on the screen of the LED display device may increase when the level of the image input signal is high. On the contrary, the brightness of the image displayed on the screen of the LED display device may decrease when the level of the image input signal is low.

Since a line flicker phenomenon is highly likely to occur in a dark image, the possibility of occurrence of the line flicker phenomenon may be high when the level of the image input signal is low. Accordingly, as described above, the LED display device may predict that the line flicker phenomenon will occur when the level of the image input signal is less than or equal to a pre-set value. For example, as shown in FIG. 3, it may be determined that a line flicker phenomenon will occur when the LED display device displays an image of brightness corresponding to a region where a level of an input image signal is less than or equal to 30.

The relationship between the level of the input image signal and the brightness may be determined via any one of various methods, and is not limited to the above relationship. For example, the relationship between the level of the input image signal and the brightness may be determined based on an external input. As another example, the relationship between the level of the input image signal and the brightness may be self-determined by the LED display device. Since defining of the relationship between the level of the input image signal and the brightness is defining of the level of the input image signal, the level of the input image signal may be defined via any one of various methods described above.

Figure 4:
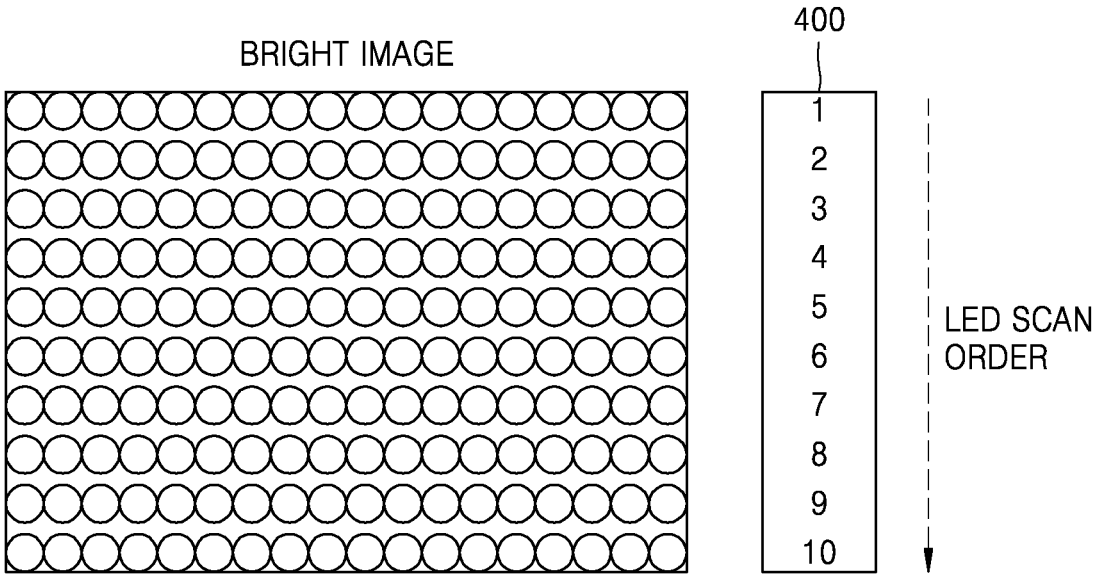
FIG. 4 is a diagram for describing an LED line scan order of an LED display device, according to an embodiment.

FIG. 4 is a diagram for describing an LED line scan order 400 of an LED display device, according to an embodiment.

FIG. 4 illustrates an example when the LED display device needs to display a bright image on a screen. A level of an input image signal corresponding to brightness of the bright image may be relatively high compared to that of a non-bright image. For example, when the level is an 8-bit gray level, the level may have a value of 180 from among 0 to 255.

For example, since the level of the input image signal has a high value of 180, the LED display device may determine that a line flicker phenomenon will not occur even when a current LED line scan order is maintained. Accordingly, the LED display device may maintain the LED line scan order 400. For example, as shown in FIG. 4, ten LED lines of the LED module, i.e., Line0 to Line9, may be sequentially scanned. The Line0 is a first row in the LED module, the Line1 is a second row in the LED module, and the Line 9 is a tenth row in the LED module.

As another example, the LED display device may obtain the LED line scan order 400 corresponding to 180, i.e., the level of the input image signal. The LED line scan order 400 corresponding to 180, i.e., the level determined not to cause a line flicker phenomenon, may be an order of sequentially scanning from a first LED line to a last LED line. For example, as shown in FIG. 4, Line0 to Line 9 may be sequentially scanned. The LED display device may obtain the LED line scan order 400 corresponding to 180, i.e., the level of the input image signal, by using a table including information about LED line scan orders corresponding to levels of input image signals and brightnesses.

The LED display device may drive at least one LED line based on the current or obtained LED line scan order 400. Since an LED line is driven based on an LED line scan order determined not to cause a line flicker phenomenon, a line flicker phenomenon may not occur.

Figure 5:
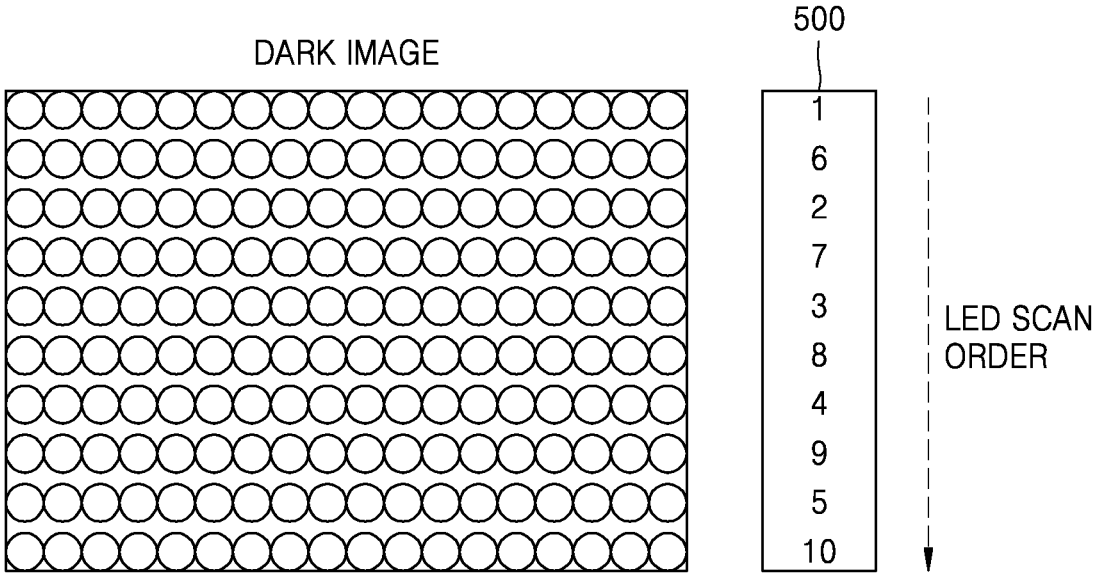
FIG. 5 is a diagram for describing an LED line scan order of an LED display device, according to another embodiment.

FIG. 5 is a diagram for describing an LED line scan order of an LED display device, according to another embodiment.

FIG. 5 illustrates an example when the LED display device needs to display a dark image on a screen. A level of an input image signal corresponding to brightness of the dark image may be relatively low compared to that of a non-bright image. For example, when the level is an 8-bit gray level, the level may have a value of 20 from among 0 to 255.

According to an embodiment, since the level of the input image signal has a low value of 20, the LED display device may determine that a line flicker phenomenon may occur when a current LED line scan order is maintained. Accordingly, the LED display device may obtain a new LED line scan order. For example, the LED display device may obtain an LED line scan order 500 corresponding to 20, i.e., the level of the image input signal, as shown in FIG. 5.

For example, as shown in FIG. 5, the newly obtained LED line scan order 500 may be an order in which odd$^{th}$ LED lines are scanned first, and then even$^{th}$ LED lines are scanned. Numbers in the LED line scan order 500 may indicate an order in which LED lines at locations corresponding to the numbers are scanned. For example, the LED line scan order 500 of FIG. 5, that is, 1, 6, 2, 7, 3, 8, 4, 9, 5, and 10 indicates that the Line 0 is scanned first, the Line 2 is scanned sixth, and the Line 3 is scanned second, and so on. That is, each number represents an order in which the corresponding Line is scanned. Accordingly, there are ten LED lines, the LED lines are scanned in an order of Line0, Line2, Line4, Line6, Line8, Line1, Line3, Line5, Line7, and Line9.

As another example, the new LED line scan order may be an order of scanning even$^{th}$ LED lines first, and then scanning odd$^{th}$ LED lines. As another example, when there are ten LED lines, the new LED line scan order may be an order of sequentially scanning Line0, Line3, Line6, Line9, Line1, Line4, Line7, Line2, Line5, and Line8. The new LED line scan order is not limited to the above examples, and may be an arbitrary order that does not cause a line flicker phenomenon in the level of the input image signal.

The LED display device may drive at least one LED line based on the new LED line scan order. Since it is determined that a line flicker phenomenon may occur when the current LED line scan order is maintained, the LED display device may newly obtain an LED line scan order to drive at least one LED line, thereby preventing a line flicker phenomenon.

Figures 6, 7:
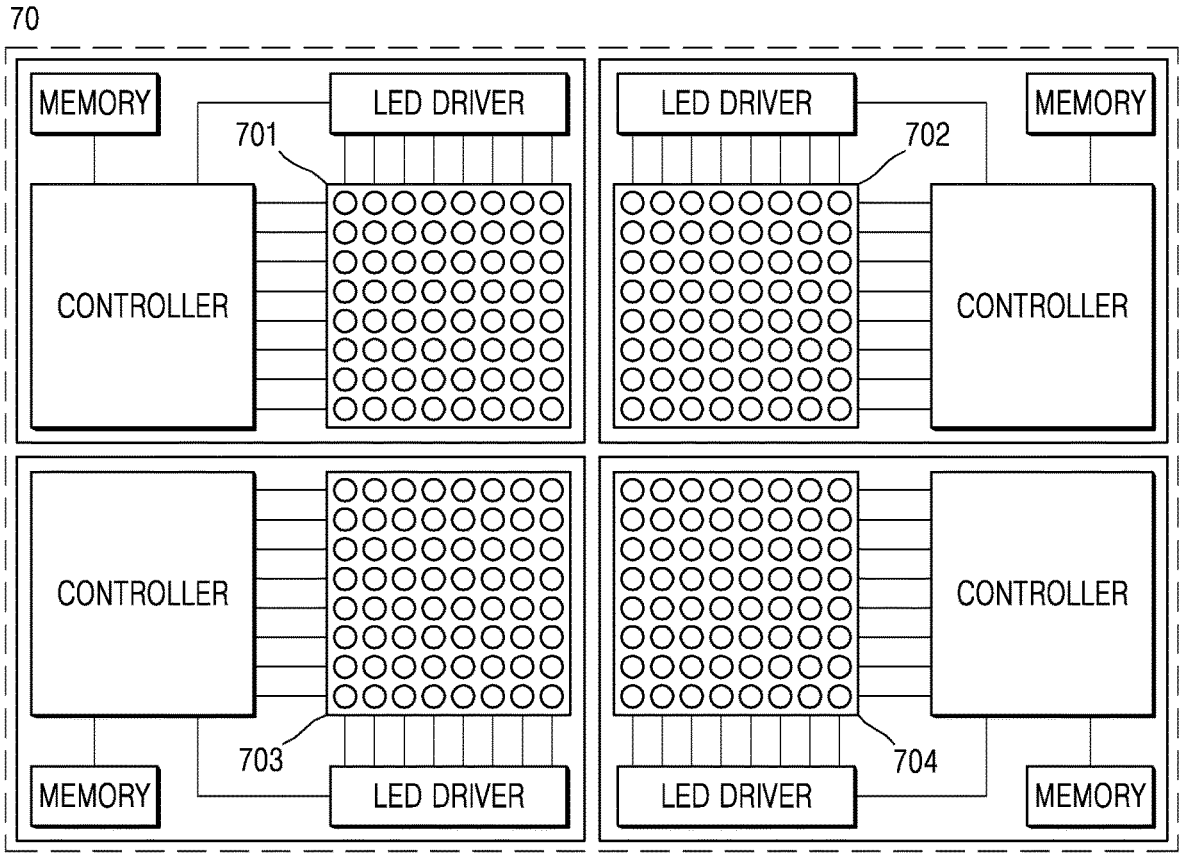
FIG. 6 illustrates a table including information about LED line scan orders corresponding to levels of input image signals, according to an embodiment.
FIG. 7 is a diagram of a structure of an LED display device including a plurality of LED modules, according to an embodiment.

FIG. 6 illustrates a table 600 including information about LED line scan orders corresponding to levels of input image signals, according to an embodiment.

The table 600 of FIG. 6 shows types of the LED line scan orders corresponding to the levels of the input image signals, when the level of the input image signal has an 8-bit value. The types of the LED line scan order may be TYPE0 to TYPE255 to correspond to the levels of the input image signals having values from 0 to 255. Each of TYPE0 to TYPE255 may include information about an LED line scan order. The LED line scan orders corresponding to TYPE0 to TYPE255 may be same or different from each other.

For example, the table 600 may include information about LED line scan orders corresponding to all levels of input image signals. When there are ten LED lines, TYPE0 may be in an order of Line0, Line2, Line4, Line6, Line8, Line1, Line3, Line5, Line7, and Line9, TYPE1 may be in an order of Line1, Line3, Line5, Line7, Line9, Line0, Line2, Line4, Line6, and Line8, and TYPE3 may be in an order of Line0, Line3, Line6, Line9, Line1, Line4, Line7, Line2, Line5, and Line8. Each of TYPE4 to TYPE255 may include an arbitrary order. Types of LED line scan orders respectively corresponding to levels of image input signals may be determined via any one of various manners, and are not limited to above examples.

As another example, levels of input image signals may be divided into certain ranges, and the table 600 may include information about LED line scan orders corresponding to the ranges. For example, when the levels of the input image signals are in a range from 30 to 255, TYPE30 to TYPE255 may be the same types. Accordingly, LED line scan orders corresponding to levels in the range from 30 to 255 may be the same. For example, when there are ten LED lines, Line0 to Line9 may be sequentially scanned.

In the table 600, an LED line scan order corresponding to a level of an input image signal may be an order that does not cause a line flicker phenomenon when at least one LED line is driven according to the order. The LED line scan order corresponding to the level of the input image signal may be determined based on an external input. Alternatively, the LED line scan order corresponding to the level of the input image signal may be self-determined by the LED display device.

FIG. 7 is a diagram of a structure of an LED display device 70 including a plurality of LED modules 701 through 704, according to an embodiment.

The LED display device 70 may include the plurality of LED modules 701 through 704 each including at least one LED line. For example, as shown in FIG. 7, the LED display device 70 may include four LED modules 701 through 704. Accordingly, the LED display device 70 may display an image at a resolution four times higher than an LED display device including one LED module.

According to an embodiment, the LED display device 70 may perform the above method in units of individual LED modules even though the LED display device 70 includes a plurality of LED modules. For example, the LED display device 70 may perform the above method with respect to each of the LED modules 701 through 704. The LED display device 70 may prevent a line flicker phenomenon in resolution corresponding to one LED module.

The LED display device 70 may determine whether line flicker will occur based on a level of an input image signal, obtain an LED line scan order corresponding to the level of the input image signal based on the determining, and drive the LED module 701 based on the obtained LED line scan order. The LED display device 70 may drive the LED modules 702 through 704 in the same manner. At this time, the LED line scan order may be an order for driving each of the LED modules 701 through 704.

For example, when the LED display device 70 performs the above method in units of individual LED modules, the LED line scan order for driving the LED module 701, the LED line scan order for driving the LED module 702, the LED line scan order for driving the LED module 703, and the LED line scan order for driving the LED module 704 may each be determined. The LED line scan orders may be the same or different from each other.

As another example, when the LED display device 70 includes a plurality of LED modules, the LED display device 70 may perform the above method in a unit of all of the LED modules. For example, the LED display device 70 may perform the above method with respect to all of the first through fourth LED modules 701 through 704. In this case, the LED line scan order may be an order for driving all of the first through fourth LED modules 701 through 704. The LED display device 70 may prevent occurrence of a line flicker phenomenon in units of whole resolution, considering the whole resolution of all of the first through fourth LED modules 701 through 704.

For example, when the LED display device 70 performs the above method in a unit of all of the four LED modules in FIG. 7, unlike a case when the above method is performed in units of individual LED modules, only one LED line scan order for driving the LED modules 701 through 704 may be determined.

As another example, the LED display device 70 may perform the above method in units of an arbitrary number of LED modules. For example, the LED display device 70 may perform the above method with respect to the LED modules 701 and 703, and perform the above method with respect to the LED modules 702 and 704. In this case, the LED line scan order may be an order for driving two LED modules. The LED display device 70 may prevent occurrence of a line flicker phenomenon in units of a part of whole resolution, i.e., considering the resolution of the two LED modules. A method of controlling, by an LED display device, a plurality of LED modules may be variously determined, and is not limited to the above examples.

Figure 8:
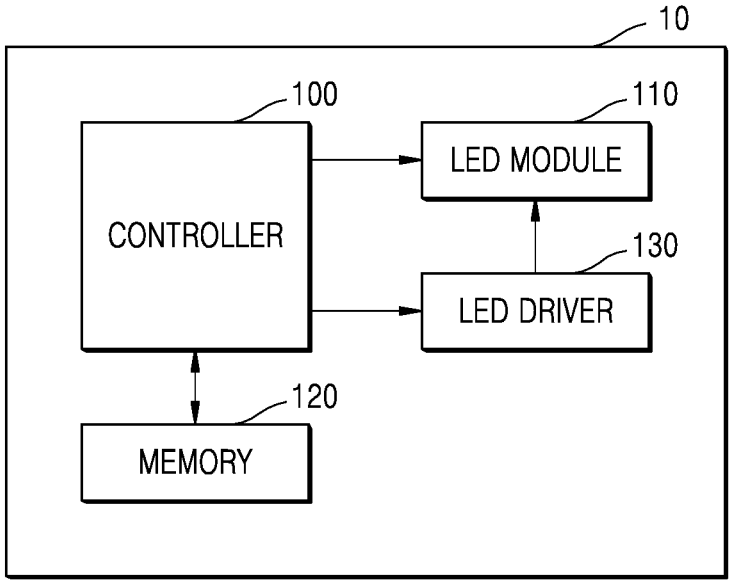
FIG. 8 is a block diagram of a structure of an LED display device, according to an embodiment.

FIG. 8 is a block diagram of a structure of the LED display device 10, according to an embodiment.

Referring to FIG. 8, the LED display device 10 according to an embodiment may include the controller 100, the LED module 110, the memory 120, and the LED driver 130.

The controller 100 may determine whether line flicker will occur based on a level of an input image signal. The level of the input image signal is a type of data input to the Led display device 10 through the input image signal.

The determining of whether the line flicker will occur means predicting in advance whether the line flicker will occur or not. The controller 100 may pre-determine whether line flicker will occur before displaying an image corresponding to a frame of the input image signal on a screen.

The controller 100 may determine that the line flicker will occur when the level of the input image signal is less than or equal to a pre-set value. Since a line flicker phenomenon is highly likely to occur when a dark image is displayed on the screen, the controller 100 may determine that the line flicker will occur when the level of the input image signal is less than or equal to the pre-set value.

According to an embodiment, the pre-set value being a criterion for determining whether the line flicker will occur may be determined based on an external input. Alternatively, the pre-set value may be self-determined by the LED display device 10 or may be a fixed value.

The controller 100 may obtain an LED line scan order corresponding to the level of the input image signal based on the determining. Since brightness of an image displayed on the screen of the LED display device 10 is determined by the input image signal according to the level of the input image signal, the controller 100 may obtain the LED line scan order corresponding to the level of the input image signal and the brightness based on the determining. According to an embodiment, the controller 100 may maintain a current LED line scan order when it is determined that the line flicker will not occur, and obtain a new LED line scan order when it is determined that the line flicker will occur.

The LED line scan order obtained when it is determined that the line flicker will occur may be adjusted differently from the LED line scan order obtained when it is determined that the line flicker will not occur because a change in the result of the determining means that the level of the input image signal is changed, and the LED line scan order corresponds to the level of the input image signal.

The controller 100 may store a table including information about LED line scan orders corresponding to levels of input image signals. Alternatively, the controller 100 may store a table including information about LED line scan orders corresponding to levels of input image signals and brightnesses. For example, the table may include information about LED line scan orders corresponding to all levels of input image signals. As another example, levels of input image signals may be divided into certain ranges, and the table may include information about LED line scan orders corresponding to the ranges. The table may include the information about LED line scan orders corresponding to levels of the input image signals in any one of various manners, and such manners are not limited to above examples.

According to an embodiment, in the information about LED line scan orders corresponding to levels of input image signals, which is included in the table, an LED line scan order corresponding to a level determined to cause line flicker may be adjusted differently from an LED line scan order corresponding to a level determined to not to cause line flicker.

The controller 100 may obtain the LED line scan order corresponding to the level of the input image signal by using the stored table. Alternatively, the controller 100 may obtain the LED line scan order corresponding to the level of the input image signal and the brightness by using the stored table. The table may be stored in the memory 120 or in the controller 110 of the LED display device 10. Also, the information about LED line scan orders corresponding to levels of the input image signals may be stored in a form other than the table.

The controller 100 may drive at least one LED line based on the obtained LED line scan order. The controller 100 may prevent occurrence of a line flicker phenomenon in all levels of input image signals by driving at least one LED line according to the obtained LED line scan order corresponding to the level of the input image signal.

The controller 100 may obtain, from the memory 120, data for controlling each of the at least one LED line according to the LED line scan order. The controller 100 may obtain, from the memory 120, the data for controlling each of the at least one LED line so as to scan the at least one LED line according to the obtained LED line scan order.

The controller 100 may transmit the obtained data to the LED driver 130. The LED driver 130 may drive the at least one LED line according to the LED line scan order corresponding to the received data. The LED driver 130 drive the at least one LED line according to the obtained LED line scan order such that occurrence of a line flicker phenomenon is prevented in all levels of input image signals.

The controller 100 may perform the method described above whenever a frame of the input image signal is changed. The controller 100 may determine whether the line flicker phenomenon will occur per frame and adjust an LED line scan order such that occurrence of a line flicker phenomenon is prevented in all frames. According to an embodiment, the LED line scan order of the LED display device 10 may not be fixed in all frames, but may be continuously adjusted per frame by the controller 100 so as to prevent occurrence of a line flicker phenomenon.

Alternatively, the controller 100 may perform the method described above during a period where at least one LED line does not operate between adjacent frames of the input image signal. A frame is distinguished by a frame-distinguishing signal, such as a vertical synchronization signal, and an LED line may not operate during a period of time when a next frame is prepared after a frame-distinguishing signal is received. The controller 100 may perform the above method during the period so as to adverse effects that may be generated by changing an LED line scan order while an LED line operates.

Meanwhile, the controller 100 may perform the method described above in units of one or more LED modules when the LED display device 10 includes a plurality of the LED modules 110. According to an embodiment, the controller 100 may perform the above method in units of individual LED modules even though the LED display device 10 includes the plurality of LED modules 110. Accordingly, each LED module 110 may be driven according to an LED line scan order adjusted such that a line flicker phenomenon does not occur.

As another example, the controller 100 may perform the above method in units of all of the LED modules. The controller 100 may drive all of the LED modules 110 according to an LED line scan order adjusted such that a line flicker phenomenon does not occur. In this case, the controller 100 may prevent occurrence of a line flicker phenomenon in units of entire resolution of all of the LED modules. As another example, the controller 100 may perform the above method in units of an arbitrary number of LED modules.

The LED module 110 may include at least one LED line. Each LED line may include a plurality of LEDs. Each LED may repeat quick flickering tens to hundreds of times per second such that a screen is displayed.

The LED module 110 may be driven in units of LED lines by a signal from the controller 100. Also, the LED module 110 may receive a signal from the LED driver 130 so as to control each of the LEDs included in each LED line.

The memory 120 may store data for controlling each of the at least one LED line included in the LED module 110. Also, the memory 120 may transmit, to the controller 100, the data for controlling each of the at least one LED line according to the LED line scan order, via control of the controller 100. Let's assume that there are six LED lines and an LED line scan order is Line0, Line2, Line4, Line1, Line3, and Line5. The memory 120 may transmit, to the controller 100, data for controlling Line0, data for controlling Line2, data for controlling Line4, data for controlling Line1, data for controlling Line3, and data for controlling Line5 in the stated order.

The LED driver 130 may drive the LED module 110 via control of the controller 100. The LED driver 130 may drive the at least one LED line according to the LED line scan order corresponding to the data received from the controller 100. The LED driver 130 may drive the at least one LED line according to the LED line scan order so as to prevent occurrence of a line flicker phenomenon in all levels of input image signals.

Meanwhile, the block diagrams of the LED display device 10 of FIGS. 1 and 8 are only embodiments, and components in the block diagrams may be integrated or omitted, or another component may be added according to actually realized specifications of the LED display device 10. In other words, two or more components may be integrated as one component or one component may be divided into two or more components as occasion demands. Also, functions performed by each component are only for describing embodiments, and detailed operations or devices do not limit the scope of the present disclosure.

The methods described above may be recorded on a computer readable recording medium by being realized in computer programs executed by using various computers. The computer readable recording medium may include at least one of a program command, a data file, and a data structure. The program commands recorded in the computer readable recording medium may be specially designed or well known to one of ordinary skill in the computer software field. Examples of the computer readable recording medium include read-only memory (ROM), random-access memory (RAM), CD-ROMs, magnetic tapes, floppy disks, optical data storage devices, etc. Examples of the computer command include mechanical codes prepared by a compiler, and high-level languages executable by a computer by using an interpreter.

While one or more embodiments have been described with reference to the figures, it will be understood by those of ordinary skill in the art that various changes in form and details may be made therein without departing from the spirit and scope as defined by the following claims.

What is claimed is:

1. A light-emitting diode (LED) display device comprising:

an LED module including at least one LED line;

an LED driver configured to drive the LED module with a current LED line scan order; and a controller configured to:

determine whether a line flicker will occur based on a level of an input image signal input to the LED display device indicating contrast to be used while forming an image displayable on the LED display device, obtain an LED line scan order corresponding to the level of the input image signal and a brightness of the image displayable on the LED display device according to the input image signal, based on the determining, and control the LED driver to drive the LED module based on the LED line scan order obtained, wherein upon the controller determining that the line flicker will not occur, the controller is arranged to control the LED driver to continue to drive the LED module using the current LED line scan order, wherein upon the controller determining that the line flicker will occur, the controller is arranged to obtain a new LED line scan order corresponding to the level of the input image signal for which the line flicker will not occur, and to control the LED driver to drive the LED module based on the new LED line scan order.

2. The LED display device of claim 1, wherein the LED line scan order that is obtained when the controller determines that the line flicker will occur is different from the LED line scan order that is obtained when the controller determines that the line flicker will not occur.

3. The LED display device of claim 1, wherein the controller determines that the line flicker will occur when the level of the input image signal is less than or equal to a pre-set value, and wherein the level of the input image signal is a gray level.

4. The LED display device of claim 3, wherein the pre-set value is determined based on an external input.

5. The LED display device of claim 1, further comprising:

a memory, and wherein the controller obtains, from the memory, data to control the at least one LED line according to the LED line scan order, and transmits the obtained data to the LED driver.

6. The LED display device of claim 1, wherein the controller obtains the LED line scan order using a table comprising information about a plurality of LED line scan orders, each LED line scan order corresponding to each level of input image signals and each brightness.

7. The LED display device of claim 1, wherein the controller controls the LED driver based on the determining of whether the line flicker will occur whenever a frame of the input image signal is changed.

8. The LED display device of claim 1, wherein the controller controls the LED driver based on the determining of whether the line flicker will occur during a period where the LED module does not operate between adjacent frames of the input image signal.

9. The LED display device of claim 1, wherein the LED module is included among a plurality of the LED modules, and the controller controls the LED driver based on the determining of whether the line flicker will occur in correspondence to at least one LED module among the plurality of the LED modules.

10. A method of operating a light-emitting diode (LED) display device including an LED module having at least one LED line, the method comprising:

determining whether a line flicker will occur based on a level of an input image signal input to the LED display device indicating contrast to be used while forming an image displayable on the LED display device;

obtaining an LED line scan order corresponding to the level of the input image signal and a brightness of an image displayable on the LED display device according to the input image signal, based on the determining; and driving the at least one LED line based on the LED line scan order obtained, wherein, the method further comprises:

upon determining that the line flicker will not occur, continuing to drive the LED module using a current LED line scan order, and upon determining that the line flicker will occur, obtaining a new LED line scan order corresponding to the level of the input image signal for which the line flicker will not occur and driving the LED module based on the new LED line scan order.

11. The method of claim 10, wherein the LED line scan order that is obtained when the determining determines that the line flicker will occur is different from the LED line scan order that is obtained when the determining determines that the line flicker will not occur.

12. The method of claim 10, wherein the determining comprises determining that the line flicker will occur when the level of the input image signal is less than or equal to a pre-set value, and wherein the level of the input image signal is a gray level.

13. The method of claim 12, wherein the pre-set value is determined based on an external input.

14. The method of claim 10, wherein the driving further comprises:

obtaining data to control the at least one LED line according to the LED line scan order; and transmitting the obtained data to an LED driver.

15. The method of claim 10, further comprising:

obtaining the LED line scan order using a table comprising information about a plurality of LED line scan orders, each LED line scan order corresponding to each level of input image signals and each brightness.

16. The method of claim 15, wherein, in the information about LED line scan orders corresponding to the levels of input image signals and brightnesses, an LED line scan order obtained when the determining determines that line flicker will occur is different from an LED line scan order obtained when the determining determines that line flicker will not occur.

17. The method of claim 15, wherein the obtaining comprises obtaining the LED line scan order corresponding to the level of the input image signal and the brightness by using the stored table.

18. The method of claim 10, wherein the method is performed whenever a frame of the input image signal is changed.

19. The method of claim 10, wherein the method is performed during a period where the at least one LED line does not operate between adjacent frames of the input image signal.

20. A non-transitory computer-readable recording medium having recorded thereon a program which, when executed by a computer, performs the method of claim 10.

* * * * *